US011193654B2

(12) United States Patent
Parsons et al.

(10) Patent No.: US 11,193,654 B2
(45) Date of Patent: Dec. 7, 2021

(54) UTILITY BAY LUMINAIRE

(71) Applicant: Hubbell Incorporated, Shelton, CT (US)

(72) Inventors: Dustin Parsons, Greer, SC (US); Derek Brannon, Greenville, SC (US); Taylor Jenson, Taylors, SC (US); Thomas Holscher, Simpsonville, SC (US); Joseph Engle, Taylors, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/401,325

(22) Filed: May 2, 2019

(65) Prior Publication Data

US 2019/0338923 A1 Nov. 7, 2019

Related U.S. Application Data

(60) Provisional application No. 62/665,865, filed on May 2, 2018, provisional application No. 62/733,862, filed on Sep. 20, 2018.

(51) Int. Cl.

| | |
|---|---|
| ***F21V 29/00*** | (2015.01) |
| ***F21V 15/01*** | (2006.01) |
| ***F21V 29/77*** | (2015.01) |
| ***F21V 23/00*** | (2015.01) |
| *F21Y 115/10* | (2016.01) |
| *F21V 7/00* | (2006.01) |
| *F21V 17/00* | (2006.01) |
| *F21S 8/06* | (2006.01) |
| *F21W 131/40* | (2006.01) |

(52) U.S. Cl.

CPC ..... *F21V 15/01* (2013.01); *F21V 23/008* (2013.01); *F21V 29/773* (2015.01); *F21S 8/06* (2013.01); *F21V 7/00* (2013.01); *F21V 17/002* (2013.01); *F21W 2131/40* (2013.01); *F21Y 2115/10* (2016.08)

(58) Field of Classification Search

CPC ..... F21V 15/01; F21V 29/773; F21V 23/008; F21V 7/00; F21V 17/002; F21S 8/06

See application file for complete search history.

(56) References Cited

U.S. PATENT DOCUMENTS

| | | | | | |
|---|---|---|---|---|---|
| 4,415,957 | A * | 11/1983 | Schwartz | F21S 8/033 | 362/147 |
| 5,440,466 | A * | 8/1995 | Belisle | F21V 17/107 | 362/222 |
| 5,746,507 | A * | 5/1998 | Lee | F21V 21/04 | 362/147 |
| 6,439,741 | B1 * | 8/2002 | Diaz | F21S 8/04 | 362/217.16 |
| 7,387,410 | B2 * | 6/2008 | Sibout | F21V 7/0016 | 362/375 |

(Continued)

*Primary Examiner* — Arman B Fallahkhair

(74) *Attorney, Agent, or Firm* — Michael Best & Friedrich LLP (Hubbell)

(57) ABSTRACT

A high bay luminaire includes a heat sink having a substantially disc-shaped configuration. A light emitter, reflector, and housing are connected to the heat sink. The housing includes a first arm, a second arm, a top bar, a bottom bar, and a door moveable between an open position and a closed position. A driver is connected to and moveable with the door.

20 Claims, 8 Drawing Sheets

(56) References Cited

U.S. PATENT DOCUMENTS

| | | | | |
|---|---|---|---|---|
| 9,039,254 | B2 * | 5/2015 | Danesh | F21V 21/30 362/364 |
| 9,651,238 | B2 * | 5/2017 | Badley | F21V 23/009 |
| 9,995,444 | B2 * | 6/2018 | Leichner | F21S 4/28 |
| 10,164,415 | B2 * | 12/2018 | Wronski | F21V 21/048 |
| 10,581,860 | B2 * | 3/2020 | Li | H04W 12/0802 |
| 2017/0102116 | A1 * | 4/2017 | Sherry | F21V 29/70 |
| 2017/0184261 | A1 * | 6/2017 | Casper | F21V 23/02 |

* cited by examiner

UTILITY BAY LUMINAIRE

CROSS-REFERENCE TO RELATED APPLICATION

This application claims priority to U.S. Application No. 62/665,865, filed May 2, 2018, and to U.S. Application No. 62/733,862, filed Sep. 20, 2018 the entire contents of these are incorporated herein by reference.

FIELD

Various exemplary embodiments relate to light fixtures or luminaires, for example indoor luminaires.

BACKGROUND

Light fixtures, or luminaires, are used with electric light sources to provide an aesthetic and functional housing in both interior and exterior lighting applications. For example, high bay luminaires can be used in larger open indoor environments such as heavy industrial settings, warehouses, gyms, churches, and shopping malls. Conventional high bay lighting fixtures for commercial and industrial applications are often mounted or suspended from ceiling joists high above the floor.

Recently, lighting fixtures have begun using light emitting diodes (LEDs) as a light source. The use of LEDs comes with unique light distribution and thermal management requirements for both the light emitters and the control components required to run the light fixtures. These considerations can lead to complex housing and heat dissipation designs in an attempt to balance performance and aesthetic characteristics.

SUMMARY

According to an exemplary embodiment, a high bay luminaire includes a heat sink having a substantially disc-shaped configuration. A light emitter, reflector, and housing are connected to the heat sink. The housing includes a first arm, a second arm, a top bar, a bottom bar, and a door moveable between an open position and a closed position. A driver is connected to and moveable with the door.

According to another exemplary embodiment, a high bay luminaire includes a heat sink with a light emitter, reflector, and housing connected to the heat sink. The housing includes a first arm, a second arm, a top bar, a bottom bar, and a door moveable between an open position and a closed position. An L-shaped bracket extends from the bottom bar. The bracket has a first section extending outward relative to the bottom bar and a second section extending upward away from the heat sink. The door includes a slot receiving the bracket. The door is rotatable relative to the bracket to position the door between an open position and a closed position.

According to yet another exemplary embodiment, a high bay luminaire includes a heat sink having a substantially disc-shaped configuration. A light emitter, reflector, and a housing are connected to the heat sink. The housing includes a first arm, a second arm, a top bar, a bottom bar, and a door moveable between an open position and a closed position. The first arm, second arm, top bar, and bottom bar at least partially define a chamber. A control component is connected to and moveable with the door. When the door is in the closed position the control component is positioned inside the chamber and when the door is in the open position the control component is positioned outside the chamber.

BRIEF DESCRIPTION OF THE DRAWINGS

The aspects and features of various exemplary embodiments will be more apparent from the description of those exemplary embodiments taken with reference to the accompanying drawings.

DETAILED DESCRIPTION OF EXEMPLARY EMBODIMENTS

In an exemplary embodiment, a high bay luminaire includes a housing assembly 10, one or more control components, a heat sink 12, a reflector 14. One or more light emitters are connected to the heat sink 12. Different types of lenses can be connected to the heat sink 12 or reflector 14 over the light emitters. The type of reflector 14 and lens can be changed or removed entirely to provide a desired light output as would be understood by one of ordinary skill in the art.

Figure 1:
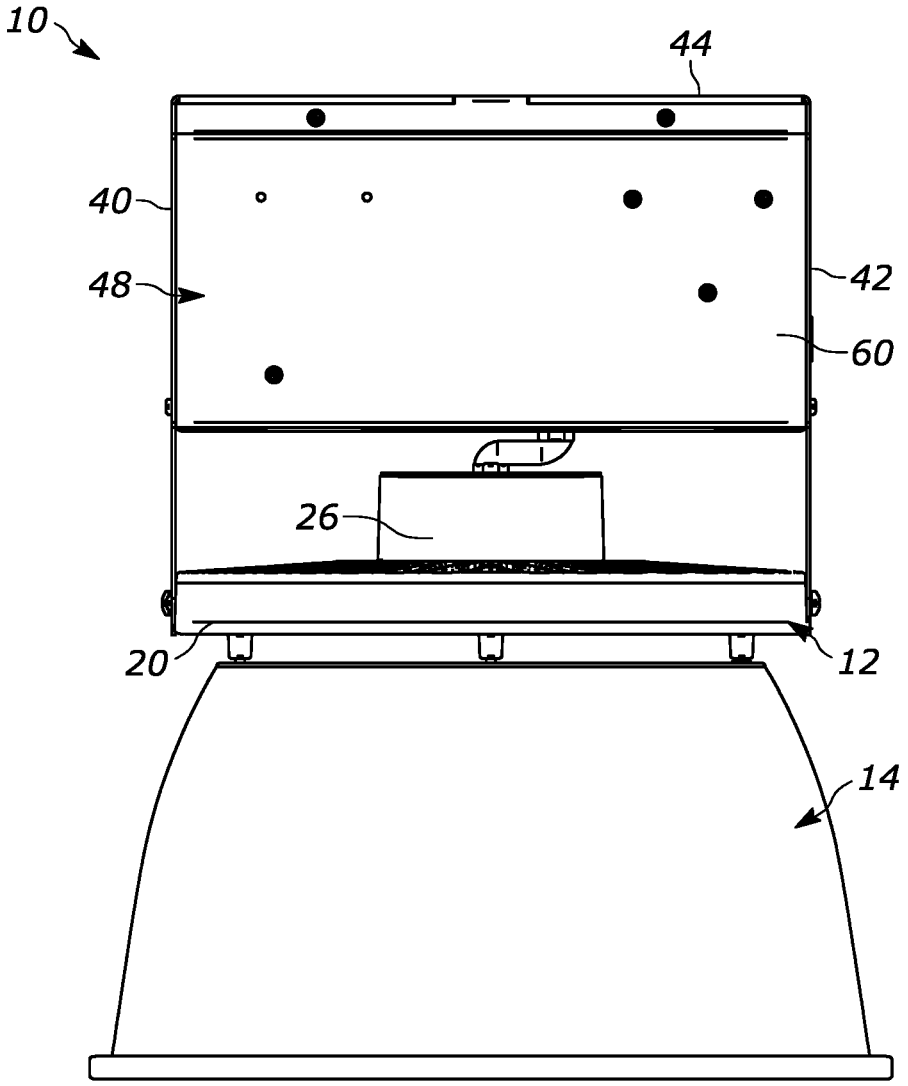
FIG. 1 is a side view of an exemplary bay luminaire.
Figure 2:
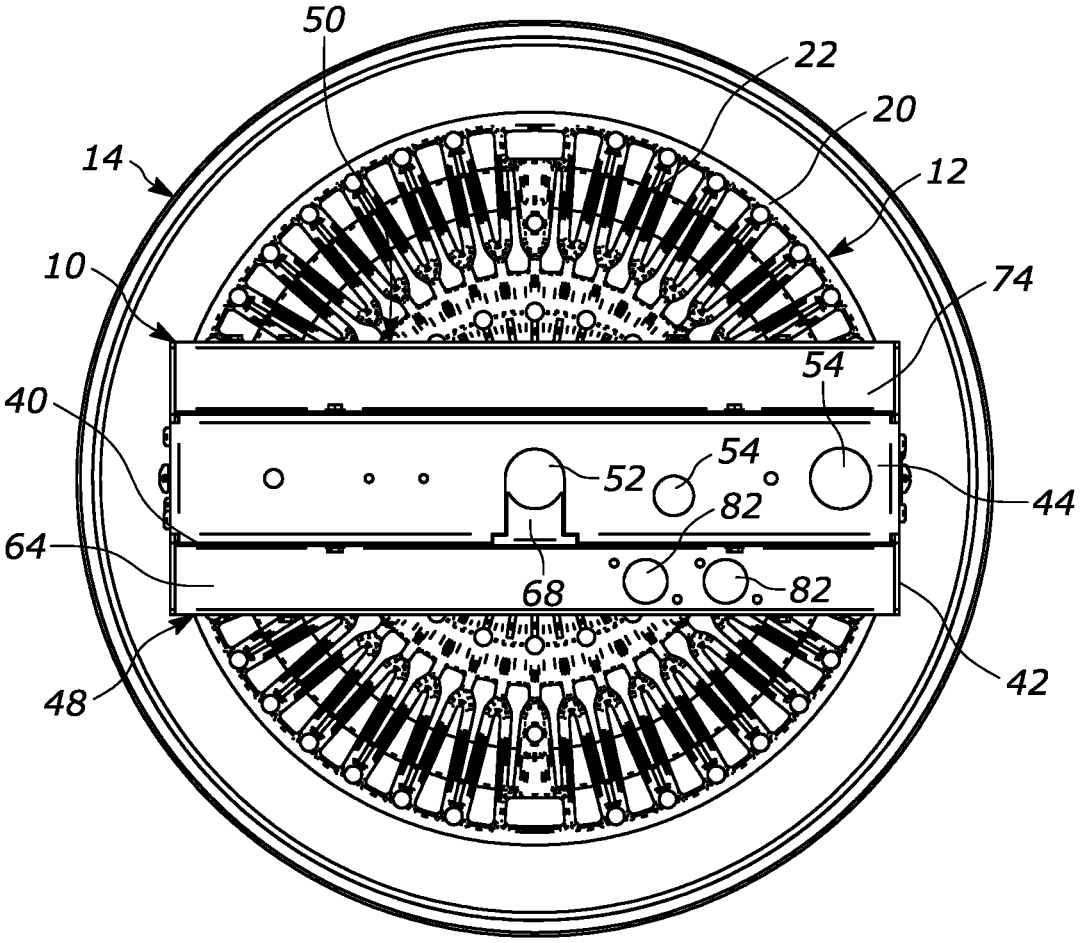
FIG. 2 is a top view of the luminaire of FIG. 1.

As shown in FIG. 2, the heat sink 12 has a base with a substantially disc-shaped configuration and a substantially circular outer portion 20. A plurality of heat fins 22 extend from the outer portion 20 to an inner portion of the heat sink 12. The heat fins 22 have a substantially Y-shape configuration with a base portion positioned towards the interior of the heat sink 12 splitting into two tines which diverge as they extend toward the outer portion 20. Different sizes, shapes, and configurations of heat fins 22 can also be used depending on the desired thermal characteristics. One or more outer mounting portions are provided on the outer edge to receive components associated with the luminaire, for example the yoke assembly 10. In this exemplary embodiment. The size, shape, and configuration of the heat sink 12 can be modified for different applications.

A cylindrical wall 26 extends from an upper portion of the heat sink 12 to define a recessed area. The recessed area can act as a junction housing to make an electrical connection between the light emitter and one or more control components. The bottom of the heat sink 12 includes a lower recessed portion for receiving a light emitter. In an exemplary embodiment, the light emitter includes a plurality of LEDs connected to a PCB. The reflector 14 is removably connected to the heat sink 12 by one or more fasteners.

Figure 3:
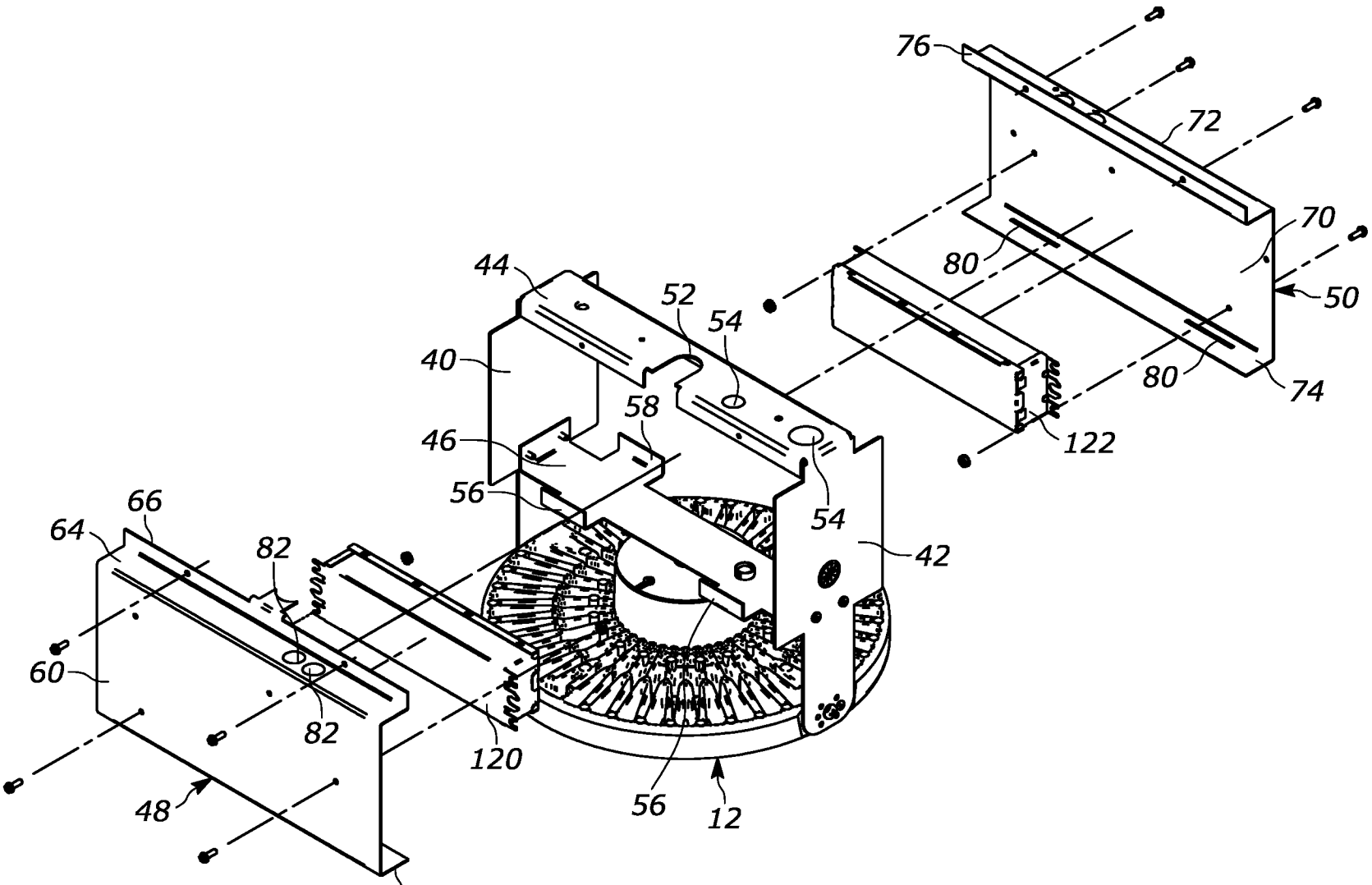
FIG. 3 is a top perspective, partially exploded view of the housing and heat sink of the luminaire of FIG. 1.

As best shown in FIG. 3, an exemplary embodiment of the housing assembly 10 includes a first arm 40, a second arm 42, a first or top bar 44 extending between the first and second arms 40, 42, and a second or bottom bar 46 extending between the first and second arms 40, 42. The first and second arms 40, 42 are coupled to the heat sink 12. The arms 40, 42 and the bars 44, 46 at least partially define an interior space. A first moveable door 48 is connected to the first side of the arms 40, 42 and a second moveable door 50 is connected to the second side of the arms 40, 42. The doors 48, 50 are moveable relative to the housing assembly 10 between an open position where the interior space is exposed, and a closed position where the interior space is enclosed. In the illustrated embodiment, the open position and the closed position are approximately 90° apart. The first and second arms 40, 42 are connected to the outer mounting portions of the heat sink 12.

Figure 6:
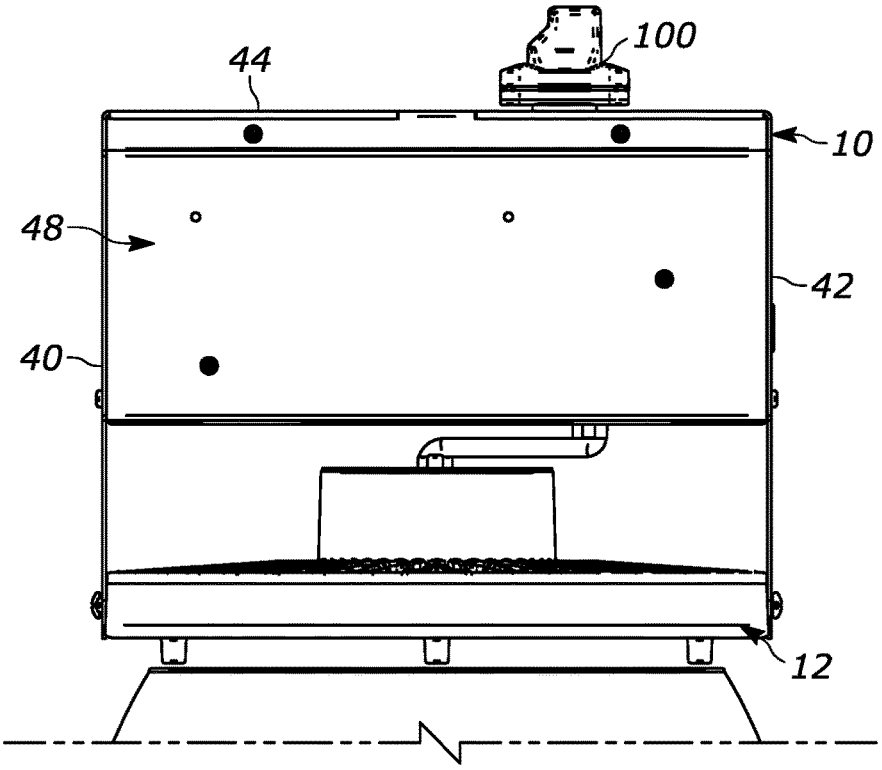
FIG. 6 is a side view showing a first exemplary communication module connected to the housing.
Figure 7:
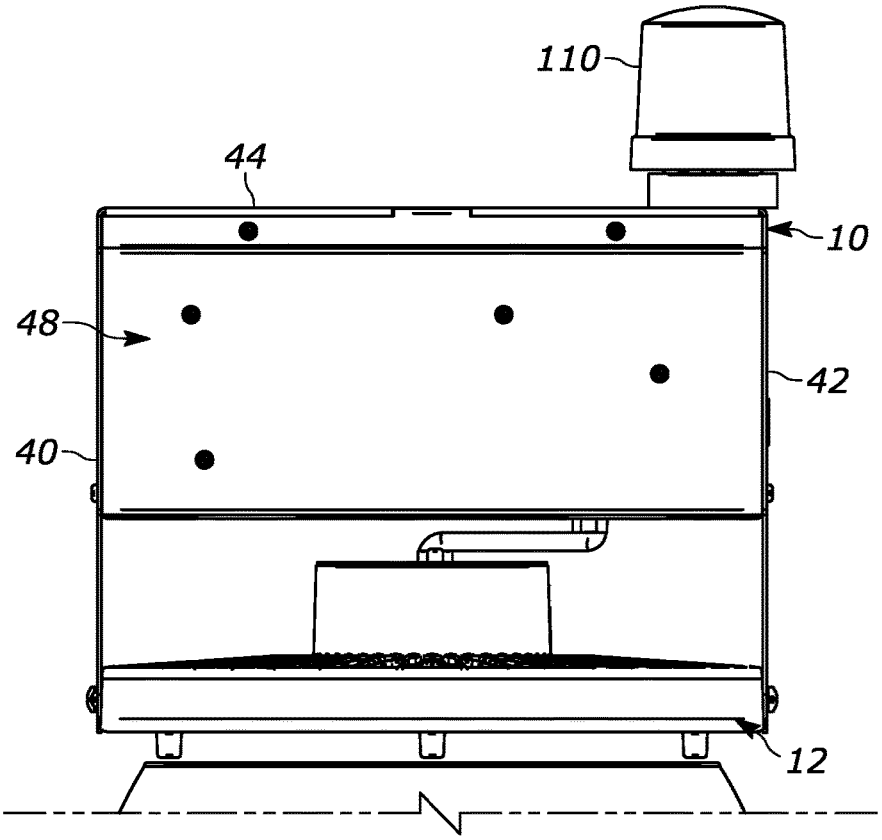
FIG. 7 is a is a side view showing a second exemplary communication module connected to the housing.

The top bar 44 includes a slot 52 for receiving a mounting component 200. The mounting component can be, for example, a pendant mount, cable mount, or hook mount that is connected to the top bar 44 via a fastener such as a locking nut assembly. The slot 52 can also act as a conduit for a power cable to extend through the housing 10 and to provide electricity to various control components. The top bar 44 also includes one or more apertures 54 (two shown) configured to receive control components, for example communication modules. FIG. 6 shows a wireless communication module 100, for example such as the HUBBELL SITESYNC fixture control module. FIG. 7 shows an example of a radio communication module 110, for example such as the HUBBELL WiSCAPE module. The apertures 54 can be covered by knock-outs and selectively removed as needed.

The bottom bar 46 includes a first set of tabs 56 extending from the first side and a second set of tabs 58 extending from the second side. The tabs 56, 58 have a substantially L-shaped configuration with a first portion extending away from the bottom bar 46 toward a respective door 48, 50 and a second portion extending from the first portion up toward the top bar 44. The doors 48, 50 may only be removed from the respective tabs 56, 58 in the closed position (i.e., the L-shaped configuration prevents them from being removed in the opened position).

Figure 9:
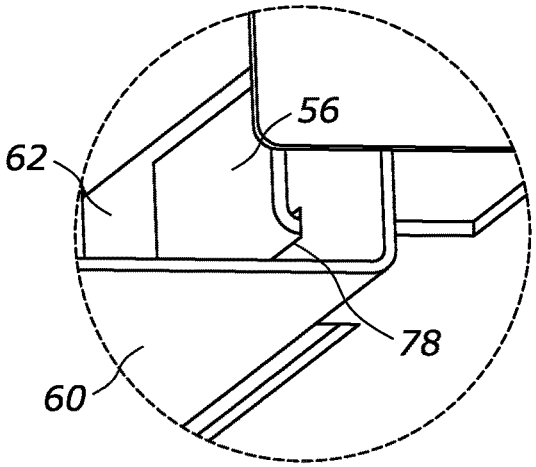
FIG. 9 is a partial, enlarged view of an exemplary pivoting connection for the door.

The first door 48 has a side wall 60, a bottom wall 62 and a top wall 64 extending from the side wall 60. An upper flange 66 extends from the top wall 64. A projection 68 having a substantially C-shaped edge extends from the upper flange 66 toward the slot 52 in the top bar 44 to engage the mounting component. The second door also includes a side wall 70, a bottom wall 72, and a top wall 74 extending from the side wall 70. An upper flange 76 extends from the top wall 74. A first set of slots 78 is provided in the bottom wall 62 of the first door 48 and a second set of slots 80 is provided in the bottom wall 72 of the second door 50. The slots 78, 80 mate with the tabs 56, 58 to pivotally connect the doors 48, 50 to the bottom bar 46 as shown in FIG. 9. The slots 78, 80 move along the L-shaped length of the respective tab 56, 58 in order to allow the door to pivot relative to the bottom bar 46. The first door 48 may pivot independently of the second door 50. The upper flanges 66, 76 may be retained using fasteners (e.g., threaded screws) in order to maintain the respective door 48, 50 in the closed position.

Figure 10:
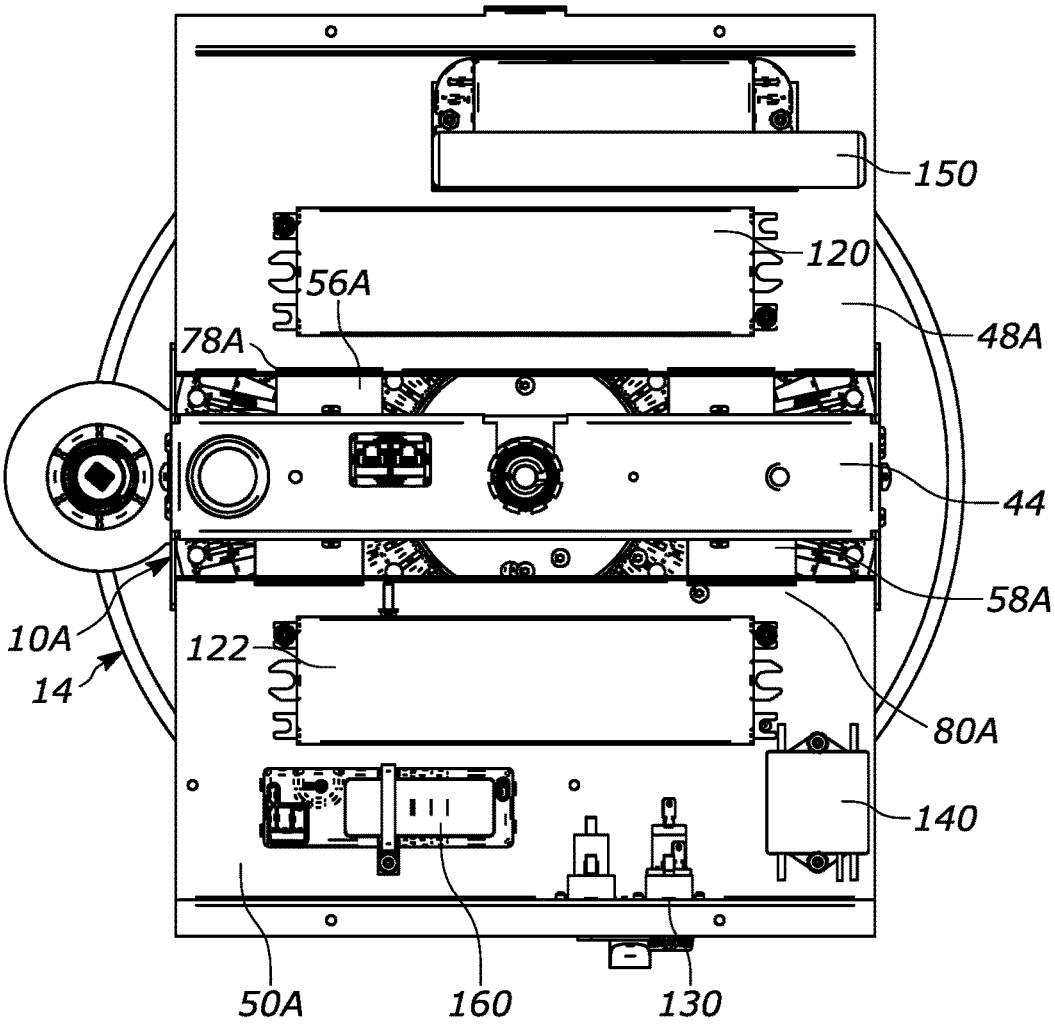
FIG. 10 is a top view of a housing with the doors in the open position and showing an exemplary control component configuration.

FIG. 10 shows an alternative embodiment of the housing assembly 10A, where the first set of tabs 56A and the second set of tabs 58A are offset from one another. For example, the first set of tabs 56A are positioned closer to the center of the housing assembly 10A and the second set of tabs 58A are positioned at least partially outside of the first set of tabs 56A. The slots 78A, 80A on the respective doors 48A, 50A are similarly offset to receive the respective tabs 56A, 58A. This offset assists in assembly to ensure that the correct door 48A, 50A is placed on the correct side of the housing assembly 10A.

Figure 4:
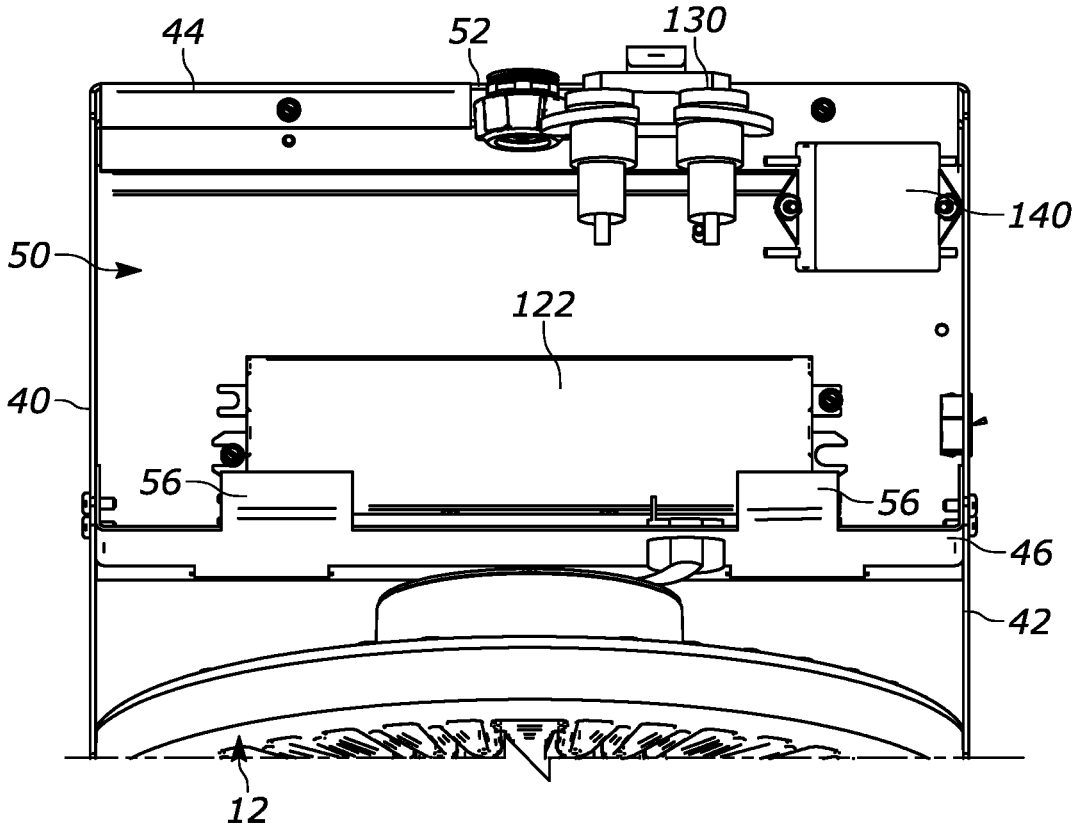
FIG. 4 is a side perspective view, showing the interior of the housing and an exemplary control component configuration connected to the housing.

Different control components can be connected to the first door 48 and the second door 50. As shown in FIG. 3, a first driver 120 is connected to the first door 48 and a second driver 122 is connected to the second door 50. In certain embodiments, only a single driver is used and can be connected to either door 48, 50. The first driver 120 and/or the second driver 122 may be in communication with the control component (e.g., the wireless communication module 100 or the radio communication module 110). In other words, a user may communicate with the control component in order to control the driver(s) 120, 122. The drivers 120, 122 receivable within the interior space when the respective doors 48, 50 are in the closed position. A pair of apertures 82 is provided in the top wall 64 of the first door 48 that are configured to receive a fuse assembly 130 as shown in FIG. 4. The fuse assembly 130 can include a double fuse element as shown or a single fuse element. The apertures 82 can be covered by knock-outs and selectively removed as needed. A surge protector 140 can also be connected to the first door 48.

Figure 5:
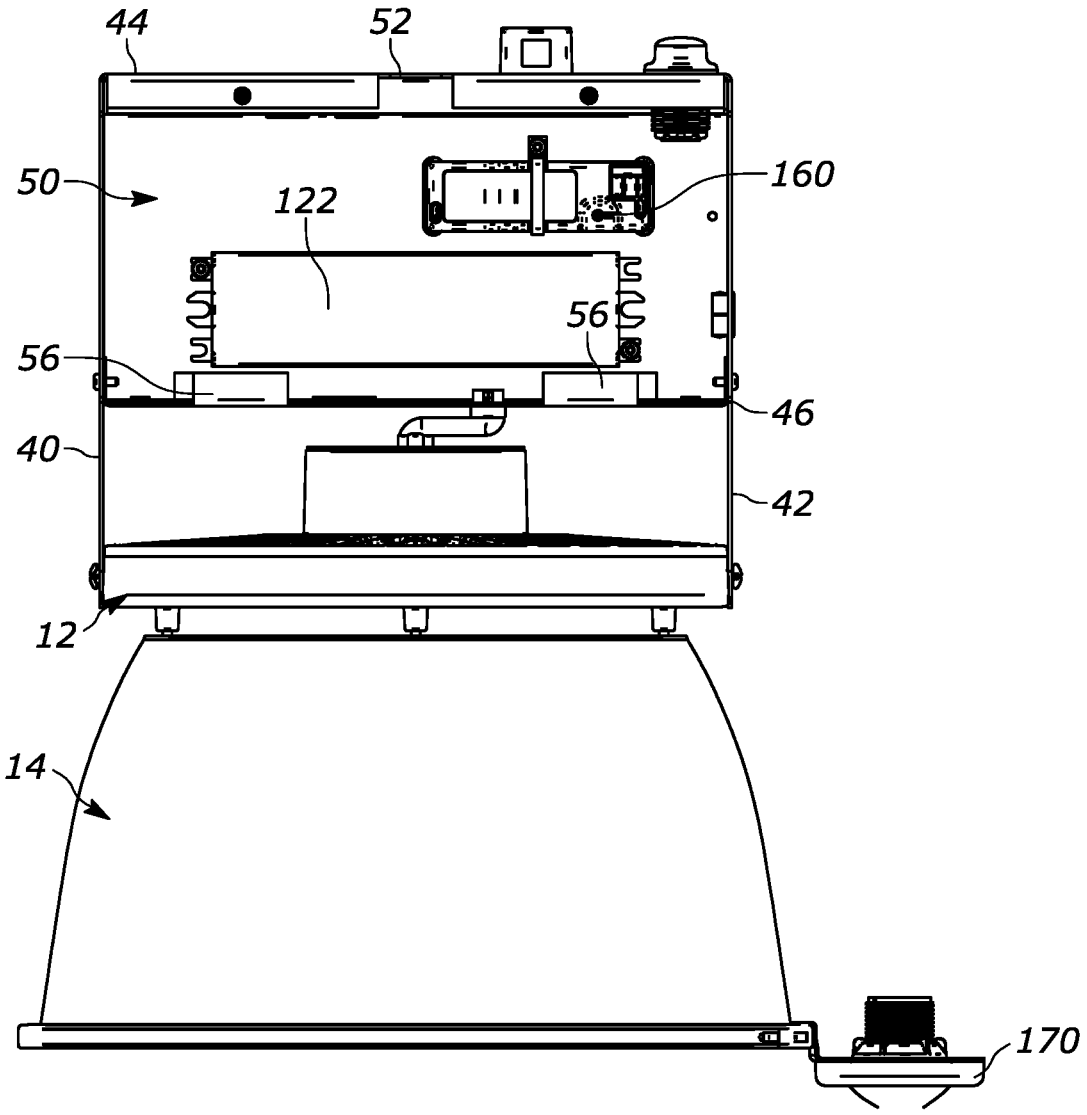
FIG. 5 is a side view showing the interior of the housing and an exemplary control component configuration connected to the housing.
Figure 8:
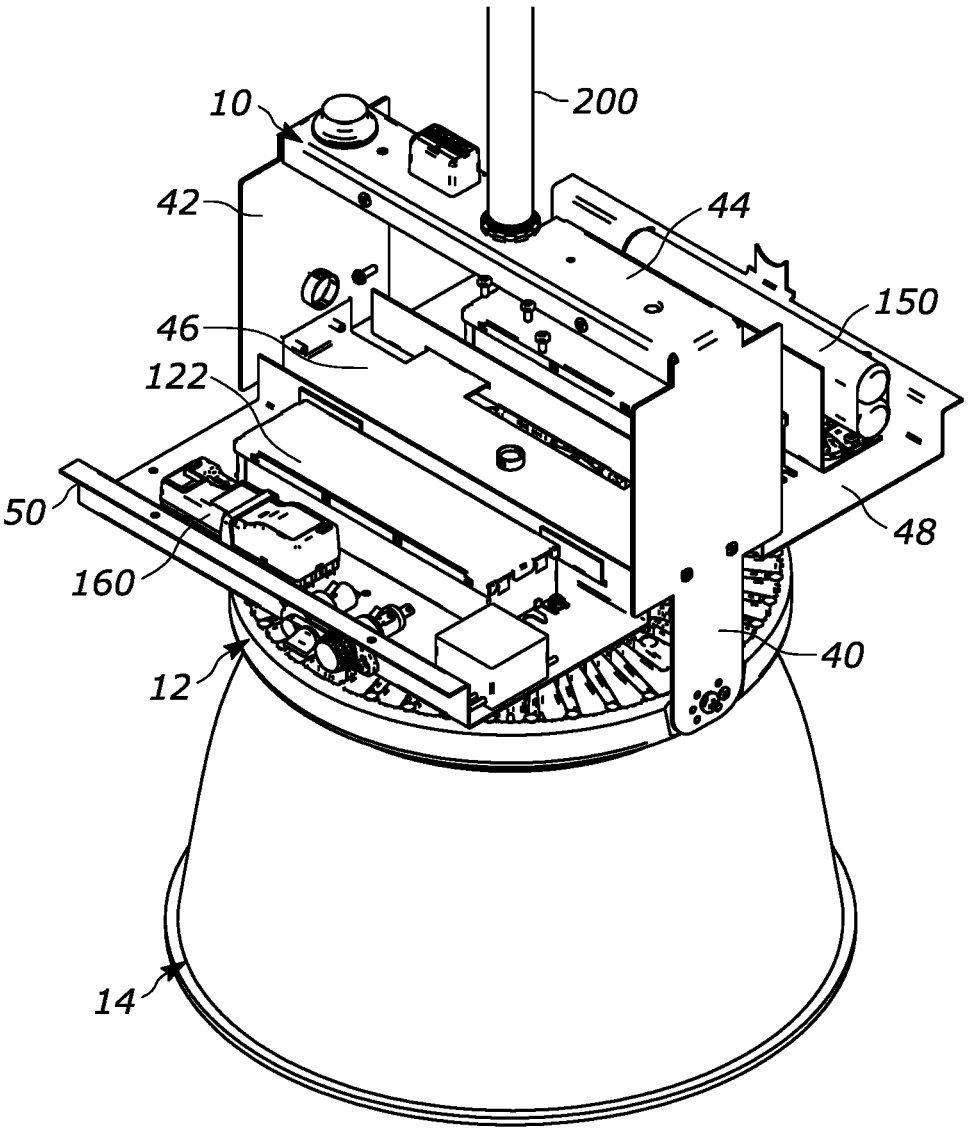
FIG. 8 is a top perspective view of the housing with the doors in the open position and showing an exemplary control component configuration.

As shown in FIGS. 5 and 8, a backup battery assembly 150 and a controller 160 can also be connected to one of the doors 48, 50. The controller 160 can be operatively connected to the driver 120, 122 to control the amount of power provided to the light emitter, for example based on input from a sensor or communication module.

Different types of sensors can be used with the luminaire, including occupancy, motion, daylight, and combination sensors. FIG. 5 shows an example of a passive infrared occupancy sensor 170 connected to the reflector 14. A cable operatively connects the sensor with one or more different control components. For example, the sensor 170 can be a relay module. The relay module can be a radio frequency device that can control loads based on an input, for example from the occupancy sensor 170.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed is:

1. A high bay luminaire comprising:

a heat sink;

a light emitter connected to the heat sink;

a reflector connected to the heat sink and positioned over the light emitter;

a housing connected to the heat sink and extending opposite to the reflector from the heat sink, the housing including a first arm, a second arm, a top bar having an opening for receiving a control component, a bottom bar, and a door extending between the first and second arms and pivotally connected to the bottom bar to be moveable between an open position and a closed position, wherein the door remains attached to the housing in the open and closed position and wherein the first and second arms, the door, the top bar, and the bottom bar at least partially define a housing interior;

a driver connected to and moveable with the door so that in the open position of the door the driver is positioned outside of the housing interior; and the control component positioned in the opening and operatively connected to the driver, the control component having a first portion positioned inside of the housing and a second portion positioned outside of the housing, wherein the heat sink is connected to the housing at a first connection point positioned on the first arm and the second arm, and wherein the bottom bar is positioned between the first connection point and the top bar.

2. The high bay luminaire of claim 1, wherein the door is pivotally connected to the bottom bar in the open position and the closed position.

3. The high bay luminaire of claim 1, wherein an inner surface of the door extends substantially orthogonal to the first and second arms in the open position.

4. The high bay luminaire of claim 1, wherein the housing includes an L-shaped tab and the door includes a slot that pivotally connects the door.

5. The high bay luminaire of claim 1, wherein the door is a first door, the high bay luminaire further comprising a second door movable between an open position and a closed position independently of the first door.

6. The high bay luminaire of claim 1, wherein the first arm and the second arm are coupled to opposite sides of the heat sink, and the top bar is coupled between the first arm and the second arm, the top bar having a slot for receiving a suspension mounting support.

7. The high bay luminaire of claim 1, further comprising a control component in communication with the driver.

8. A high bay luminaire comprising, a heat sink;

a light emitter connected to the heat sink;

a reflector connected to the heat sink and positioned over the light emitter;

a housing connected to the heat sink and extending opposite to the reflector from the heat sink, the housing including a first arm, a second arm, a top bar, a bottom bar, and a door extending between the first and second arms and pivotally connected to the bottom bar to be moveable between an open position and a closed position, wherein the first and second arms, the door, the top bar, and the bottom bar at least partially define a housing interior, and a driver electrically connected to the light emitter and physically coupled to and moveable with the door such that, in the open position of the door, the driver is moved outside of the housing interior, wherein an L-shaped tab extends from the bottom bar, the tab having a first section extending horizontally relative to the bottom bar and a second section extending vertically from the first section, and wherein the door includes a slot receiving the tab, the door rotatable relative to the tab to position the door between the open position and the closed position.

9. The high bay luminaire of claim 8, wherein the housing includes a second door and a L-shaped second tab extends from the bottom bar opposite the tab, the second tab having a first section extending outward relative to the bottom bar and a second section extending upward away from the heat sink, and wherein the second door includes a slot receiving the second tab, the door rotatable relative to the tab to position the door between an open position and a closed position.

10. The high bay luminaire of claim 8, wherein the heat sink has a substantially disc-shaped configuration.

11. The high bay luminaire of claim 8, wherein the tab limits rotation of the door through engagement with the second section.

12. The high bay luminaire of claim 8, wherein the tab is L-shaped.

13. The high bay luminaire of claim 8, further comprising a driver coupled to and moveable with the door and electrically connected to the light emitter.

14. The high bay luminaire of claim 8, wherein the door is moveable approximately 90° between the open position and the closed position.

15. A high bay luminaire comprising:

a heat sink;

a light emitter connected to the heat sink;

a reflector connected to the heat sink a positioned over the light emitter;

a housing connected to the heat sink and extending opposite to the reflector from the heat sink, the housing including a first arm, a second arm, a top bar, a bottom bar, and a door extending between the first arm and second arm and moveable between an open position and a closed position, the first arm, second arm, top bar, and bottom bar at least partially defining a chamber; and a driver electrically connected to the light emitter and physically connected to and moveable with the door, wherein when the door is in the closed position the driver is positioned inside the chamber and when the door is in the open position the driver is positioned outside the chamber and the door remains attached to the housing, wherein the heat sink is connected to the housing at a first connection point positioned on the first arm and the second arm, and wherein the bottom bar is positioned between the first connection point and the top bar, and wherein the bottom bar includes an L-shaped tab and the door includes a slot receiving the L-shaped tab the tab having a first section extending horizontally relative to the bottom bar and a second section extending vertically from the first section.

16. The high bay luminaire of claim 15, wherein the door is moveably connected to the bottom bar.

17. The high bay luminaire of claim 15, wherein the control component includes a driver configured to control a light emitter coupled to the heat sink.

18. The high bay luminaire of claim 15, wherein the top bar includes an aperture configured to provide communication into the chamber.

19. The high bay luminaire of claim 15, wherein the top bar includes a slot for receiving a suspension mounting component.

20. The high bay luminaire of claim 15, wherein the door includes a top wall having an aperture configured to receive a second control component.

* * * * *